United States Patent [19]

Wilson et al.

[11] Patent Number: 4,668,855

[45] Date of Patent: May 26, 1987

[54] SUPPORTS FOR ELECTRIC HEATING ELEMENTS

[75] Inventors: Peter H. Wilson, Stockton-on-Tees; Peter W. Bayles, Durham, both of England

[73] Assignee: Black & Decker Inc., Newark, Del.

[21] Appl. No.: 746,549

[22] Filed: Jun. 19, 1985

[30] Foreign Application Priority Data

Jun. 19, 1984 [GB] United Kingdom ..... 8415637

[51] Int. Cl.[4] ..... H05B 3/06; H05B 1/00; H05B 11/00; F24H 3/04

[52] U.S. Cl. ..... 219/370; 338/298; 338/299; 338/303; 338/268; 34/96; 219/374; 219/375; 219/544

[58] Field of Search ..... 219/374–376'381–382, 219/396–370, 544; 338/53, 296, 298, 299, 302, 303, 304, 305, 268; 34/96, 97

[56] References Cited

U.S. PATENT DOCUMENTS

| | | | |
|---|---|---|---|
| 995051 | 6/1911 | Ayer . | |
| 1620627 | 3/1927 | Berry et al. . | |
| 1,727,459 | 9/1929 | Webb | 219/550 |
| 1,738,164 | 12/1929 | Zingg | 219/374 X |
| 2,536,925 | 1/1951 | Forss | 338/298 X |
| 3,492,462 | 1/1970 | Schumacher | 219/374 X |
| 4,122,329 | 10/1978 | Godel | 219/370 |
| 4,321,456 | 3/1982 | Ohnmacht et al. | 219/375 X |
| 4,350,872 | 9/1982 | Meywald et al. | 219/375 X |
| 4,551,615 | 11/1985 | Wilson | 34/96 X |

FOREIGN PATENT DOCUMENTS

| | | | |
|---|---|---|---|
| 822775 | 9/1969 | Canada | 219/544 |
| 2849266 | 5/1980 | Fed. Rep. of Germany . | |
| 3003240 | 8/1981 | Fed. Rep. of Germany . | |
| 3036228 | 4/1982 | Fed. Rep. of Germany . | |
| 3101057 | 9/1982 | Fed. Rep. of Germany . | |
| 303727 | 1/1929 | United Kingdom | 219/550 |

OTHER PUBLICATIONS

European Search Report.

*Primary Examiner*—M. Jordan
*Assistant Examiner*—Carmine Cuda
*Attorney, Agent, or Firm*—Edward D. Murphy; Harold Weinstein; Edward D. C. Bartlett

[57] ABSTRACT

A support for an electric heating element comprises a former of generally cylindrical shape, made of a heat resisting material and having a longitudinal core from which extend spaced ribs that support an outer wall. Portions of the outer wall and of the ribs are omitted along a helical path around the core to provide a mount for an electric heating element. A heating element assembly including the support and the heating element is mounted in a hot air gun.

19 Claims, 17 Drawing Figures

SUPPORTS FOR ELECTRIC HEATING ELEMENTS

FIELD OF THE INVENTION

This invention relates to supports for electric heating elements, to heating element assemblies including such supports, to hot air guns including such assemblies, and to methods of manufacturing such supports. The invention has particular reference to supports for the electric heating elements of air heaters for example, those used in apparatus in which a stream of air is forced over the heating element. Examples of such apparatus are hair dryers and air heaters for paint stripping and similar purposes.

BACKGROUND OF THE INVENTION

It is desirable for an air heater for paint stripping to have a compact source of heat so that the heater as a whole is of an overall size that can be easily held in the hand. Because of the temperature of air required for paint stripping and the requirement for a compact source of heat the heating element has to operate at a relatively high temperature and thus the support for the element must be able to withstand the high temperature and also maintain the heating element located in position. While such supports have previously been proposed they have not proved satisfactory from all points of view. In particular the more compact forms of heating element aassembly have not proved economical to manufacture and assemble heating elements to.

SUMMARY OF THE INVENTION

It is an object of the invention to provide a support for an electric heating element, which enables a compact heating element assembly to be manufactured and assembled economically.

It is another object of the invention to provide a heating element assembly including such a support.

It is yet another object of the invention to provide a hot air gun including such an assembly.

It is yet another object of the invention to provide an economical method of manufacturing a support for an electric heating element.

According to the invention there is provided a support for an electric heating element comprising a former of generally cylindrical shape and made of a heat resisting material characterized in that the former has a longitudinal core from which extend spaced ribs that support an outer wall, portions of the outer wall and of the ribs being omitted to provide a mount for an electric heating element wound around the core.

Such a support can be made by first extruding the former and subsequently removing the protions of the outer wall and ribs, for example by machining; such a technique is particularly economical.

The omitted portions of the outer wall and ribs preferably extend along a helical path around the core thereby defining a helical slot for receiving an electric heating element wound around the core. The helical slot is able to provide a very positive location for the heating element and provides parts of the former between adjacent lengths of the element ensuring that such adjacent lengths remain insulated from one another other than along the electrical path provided by the element itself. In embodiments of the invention to be described the helical slot is partly or totally defined by parts of the ribs and is not defined so well or not defined at all in gaps between the ribs. Nonetheless it is possible to identify the path of a discontinuous helical "slot". The term "slot" as used in the specification is to be construed in a broad sense to cover such an arrangement.

The helical slot may have a depth greater than the wall thickness of the outer wall.

At least a portion of the outer wall may be provided at an end of the former or at both ends of the former. The outer wall portion at one or both ends of the former can be useful when the former is to be located inside a case of tubular form as that other body can locate on the outer wall portion(s). In such a case it may not be necessary to retain any other parts of the outer wall.

The outer wall may be divided circumferentially by a number of longitudinal slots. The support may include further ribs which extend radially from the longitudinal core and which are aligned with the longitudinal slots.

The support may be made of ceramic material.

Longitudinal air flow passages extending from one end of the former to the other may be provided between the ribs. When the support is in use in a hot air gun, air can flow down these passages which are actually within the overall volume defined by the support and thus heat exchange between the air and the heating element carried in use on the support can be enhanced.

According to another aspect of the invention there is provided a support for an electric heating element comprising a former of generally cylindrical shape and of a heat resisting material having a central logitudinal core from which extend spaced, radially-extending ribs that support an outer wall having a helical slot of a depth greater than the wall thickness of the outer wall.

According to another aspect of the invention there is provided a support for an electric heating element comprising a former of generally cylindrical shape formed in one piece from heat resisting material, the former having a longitudinal core from which spaced ribs extend radially, an outer cylindrical wall at an end of the former and connected to the longitudinal core by the ribs, an exterior helical groove being defined in the support for receiving an electric heating element within an endless cylindrical volume that incorporates the outer surface of the outer cylindrical wall.

The invention also provides a heat element assembly including a support as defined above and a heating element wound around the core of the former.

The core of the former may have a longitudinal bore and at least one electrical component may be housed in the longitudinal bore.

The heating element may be received within an endless cylindrical volume that incorporates the outer surface of the outer wall. Such an arrangement as well as being safe facilitates the location of the assembly in a case of tubular form. In the case where the outer wall of the former is divided circumferentially by a number of longitudinal slots, the case may have internal longitudinal keys that coact with the longitudinal slots. Such a location between the support and the case is able to accommodate wide tolerances.

The invention further provides a hot air gun including:

a gun housing having a hot air outlet,

A motor mounted in the housing, a fan arranged to be driven by the motor to generate a stream of air through the gun and leaving the gun through the hot air outlet, a heating element assembly located in the air flow path and including an electric heating element mounted on a support, and control means to control operation of the motor, the fan and the heating element, characterized in that the heating element assembly is as defined above.

The longitudinal axis of the former is preferably aligned with the air flow path with air flow passages defined around the core of the former between the ribs.

According to another aspect of the invention there is provided a method of making a support for an electric heating element, characterized in that a former is first formed in a cylindrical shape with a longitudinal core from which extend spaced ribs that support an outer wall, and portions of the outer wall and the ribs are subsequently removed to provide a mount for an electric heating element wound around the core. This method enables the support to be made particularly economically. As already suggested the first forming stage may be carried out by extruding and the extruded component then machined.

BRIEF DESCRIPTION OF THE DRAWINGS

By way of example only, embodiments of the invention will now be described in detail with reference to the accompanying drawings of which:-

DETAILED DESCRIPTION OF THE PREFERRED EMBODIMENTS

Figure 1:
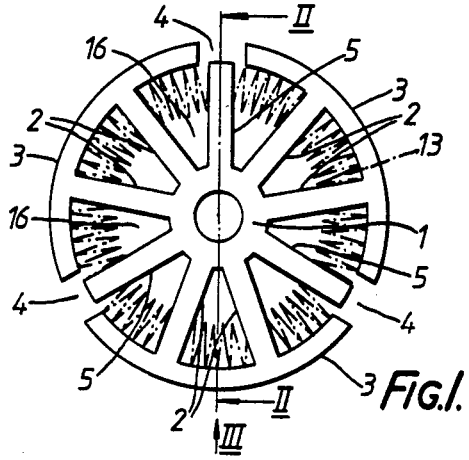
FIG. 1 is an end view of a first form of heating element support.
Figure 2:
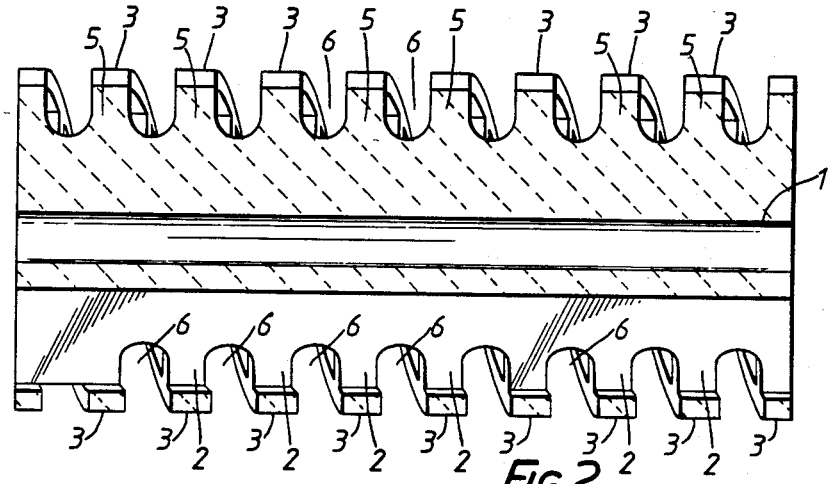
FIG. 2 is a section on the line II—II of FIG. 1.
Figure 3:
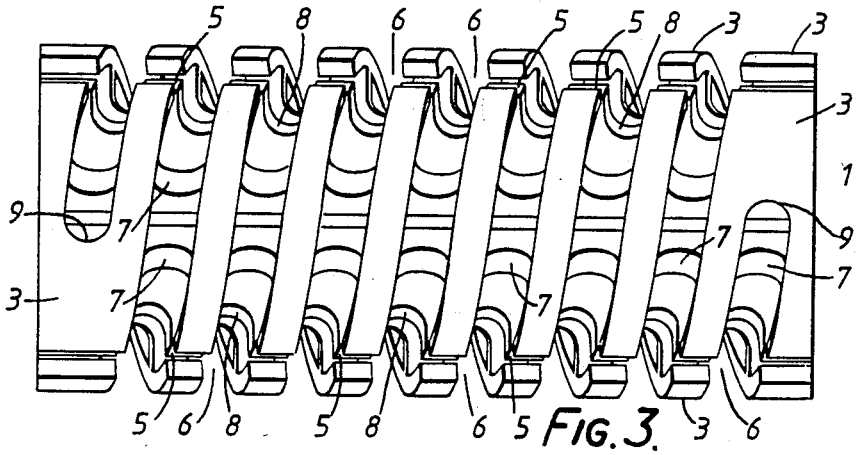
FIG. 3 is a view of the support shown in FIG. 1 in the direction of the arrow III in FIG. 1.

The support shown in FIGS. 1 to 3 is of generally cylindrical form with a central, longitudinal hollow core 1 from which extend spaced radial ribs 2 arranged in groups of two. Each group of radial ribs 2 supports a section 3 of the outer wall of the support. The sections 3, of which there are three, are of equal size and are equi-spaced round the circumference of the support being separated by longitudinal gaps 4.

Aligned with each gap 4 is a further rib 5 that extends radially from the core 1. The outer tips of the ribs 5 are spaced slightly from the inner surface of the sections 3.

The outer surface of the support is cutaway to form a two-start helical "slot" 6. The depth of the slot 6 is greater than the wall thickness of the sections 3 so that the slot extends for a short distance into each of the ribs 2 and 5. This is seen more clearly in FIG. 3 where the arcuate ended grooves in the ribs 2 and 5 are indicated at 7 and 8 respectively. Thus the bottom of the slot 6 is defined by the arcuate ended grooves of the ribs 2 and 5 while the sides of the slots are defined in their lower region by the side walls of the gooves in the ribs 2 and 5 and in their upper region by the wall sections 3.

As can also be seen from FIG. 3, the slot 6 does not break through the ends of the sections 3 but terminates inwardly thereof as indicated at 9.

As can be seen from FIG. 1 the support has a number (in the example of FIG. 1, nine) of longitudinal passageways 16 formed between adjacent ribs 2, 5 and bounded on the inside by the core 1 and on the outside by the wall sections 3.

Figure 5:
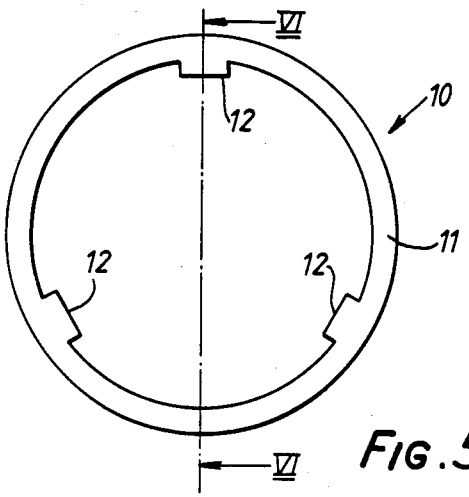
FIG. 5 is an end view of a sleeve for the support of FIG. 1.
Figure 6:
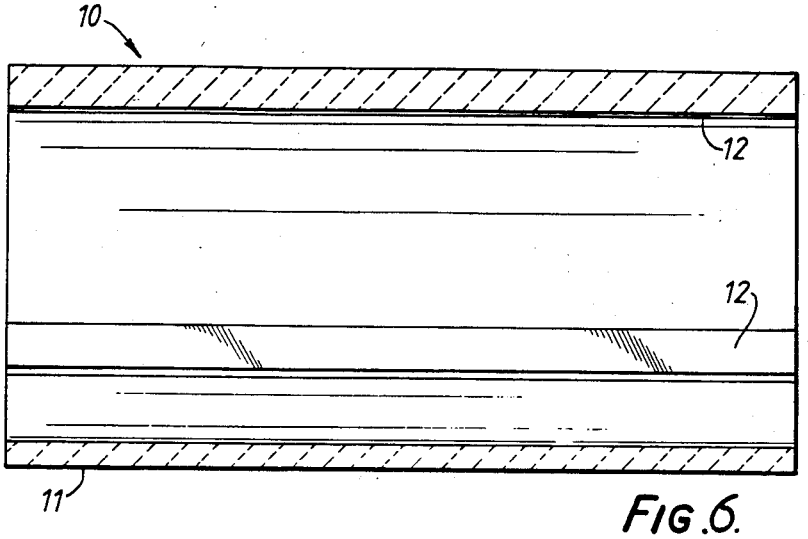
FIG. 6 is a sectional view on the line VI—VI of FIG. 5.

A sleeve in the form of a case 10 is provided for the support of FIGS. 1 to 3 and is shown in FIGS. 5 and 6 to which reference will now be made. The case 10 is of tubular form with a continuous outer wall 11 formed with three equi-spaced internal keys 12. The axial length of the case is the same as that of the support shown in FIGS. 1 to 3 whilst its maximum internal diameter (excluding the keys 12) is slightly greater than the external diameter of the support.

It is thus possible to insert the support into the case 10 and when this is done, the keys 12 mate with the longitudinal slots 4.

The support provided a former for a heating element in the form of a length of coiled resistance wire of suitable material, for example nickel chromium alloy. The coils are laid into the slot 6 and are supported upon the arcuate ends 7 and 8 of the ribs 2 and 5. The coils extend across the longitudinal passageways 16 formed in the support between the ribs 2, 5.

Figure 4:
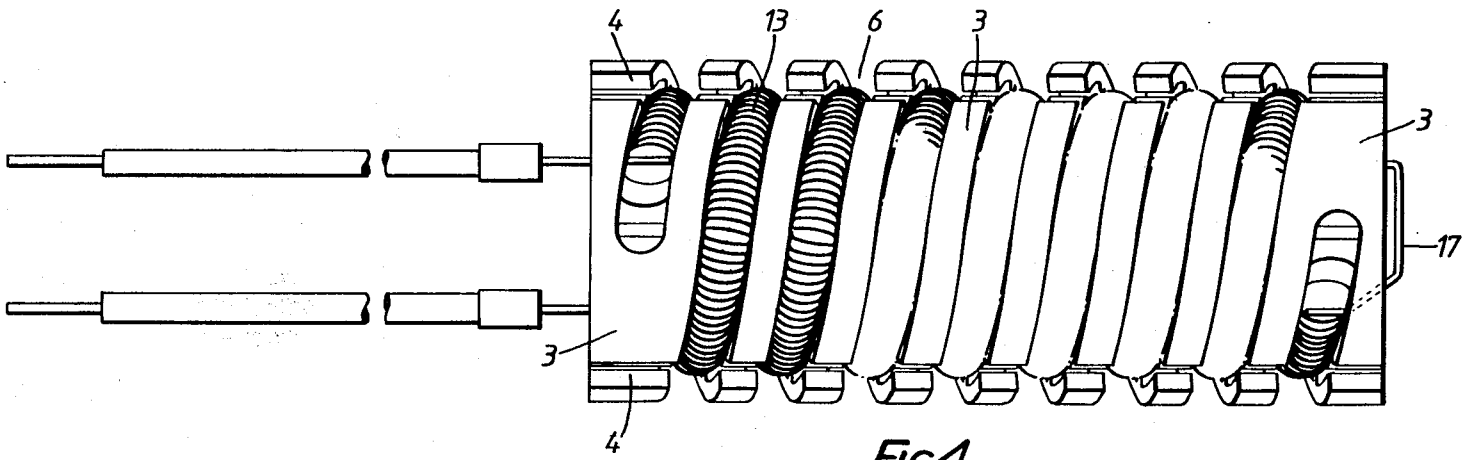
FIG. 4 is a view similar to FIG. 3 but showing a heating element mounted on the support.

Part of the element is indicated in dotted outline at 13 in FIG. 1 and the element is shown fully in FIG. 4. As can be seen, the coil 13 lies internally of the wall sections 3. The coil 13 enters and leaves the slot 6 through the longitudinal passageways 16 at one end of the support (the left hand end in FIG. 4) and passes, at the other end of the support, from one of the threads of the slot 6 to the other by passing out through the end of the support via one of the passageways 16 and back into the support through another one of the passageways 16. Rather than thread the coil 13 through the longitudinal passageways 16 (a process which while theoretically possible, would be very awkward) an unwound portion of the coil 13 is simply slipped through an appropriate one of the slots 4. Because of the presence of the ribs 5, the effective width of the slots 4 for this purpose is much reduced from their actual width and it is therefore not possible for wound parts of the coil 13 to pass through the slots 4.

The winding on of the coil 13 is preferably effected by first locating a middle portion of the coil, having a central unwound portion 17 dividing the coil into two parts, at the right hand end as seen in FIG. 4 and then winding simultaneously the two half lengths of the coil into the threads of the slot. As will be appreciated, the middle portion of the coil is located by slipping the unwound portion 17 through two of the slots 4. In an alternative winding operation, winding into one of the slot threads would be commenced at one end of the slot and continued to the other end and then returned to the first end in the other thread of the slot.

After the coil has been wound on to the support, the latter is inserted into the case 10. The keys 12 being of significant depth accommodate tolerance variations in the diameters of the sections 3 and the case 10.

Figure 8:
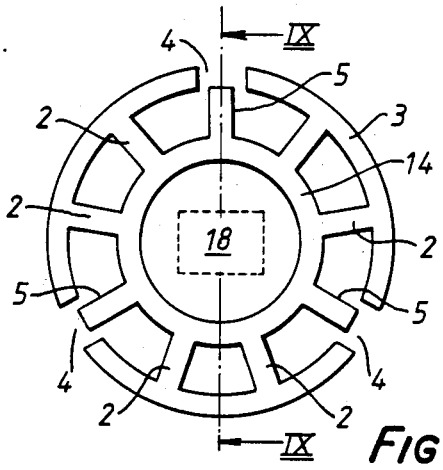
FIG. 8 is an end view of a second form of heating element support.
Figure 7:
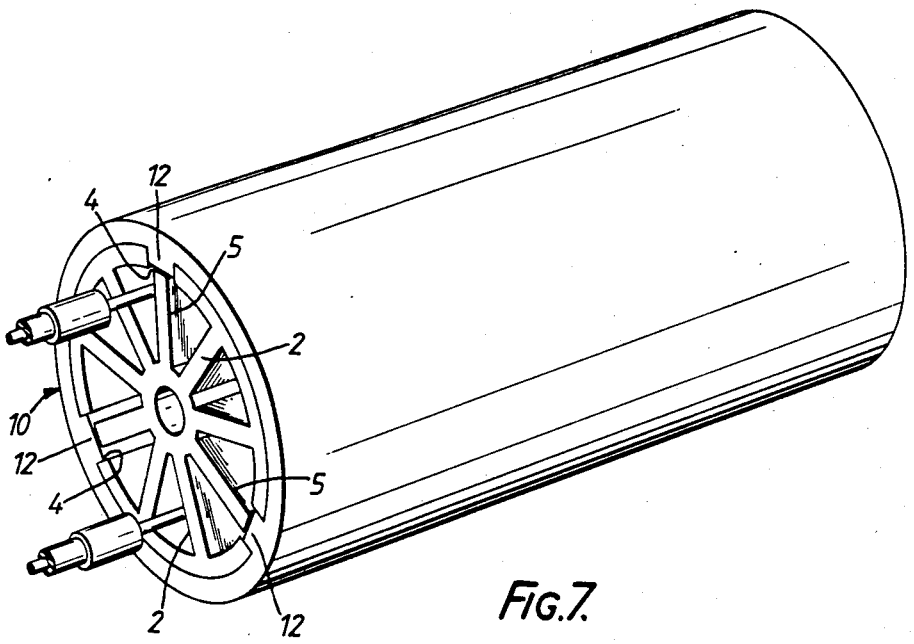
FIG. 7 is a perspective view of a heating element assembly comprising the support and heating element shown in FIG. 4 and the sleeve shown in FIGS. 5 and 6.
Figure 9:
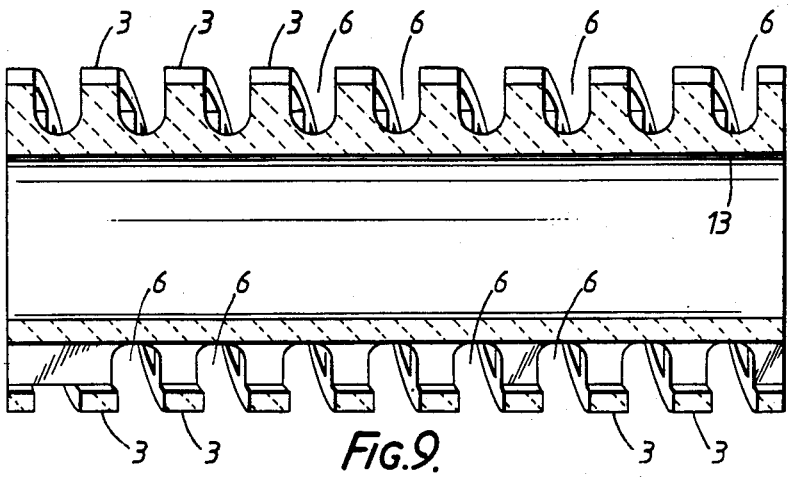
FIG. 9 is a view on the line IX—IX of FIG. 8.
Figure 10:
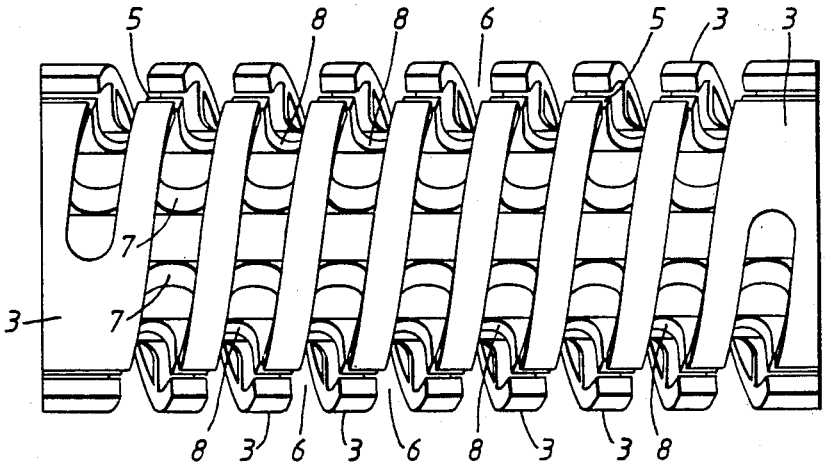
FIG. 10 is a view of the support shown if FIG. 8 in the direction of the arrow X in FIG. 8.

An alternative form of support is shown in FIGS. 8 to 10. The support differs from that described above with reference to FIGS. 1 to 3 in that the core is of considerably greater diameter as shown in FIG. 8 and indicated at 14. Thus the bottom of the helical slot 6 is defined by the outside of the core and is continuous. The construction of the support is otherwise the same and it is housed within a case identical with that shown in FIGS. 6 and 7. Corresponding parts shown in FIGS. 1 to 4 and FIGS. 8 to 10 are designated by the same reference numerals.

The much larger diameter bore of the core 14 may be used to accommodate other components of the apparatus. For example, in the case of a hot air paint stripper, the bore may accommodate electronic controls for the heating element or for the electric motor that drives the fan for forcing air over the electric coil. The bore may also house a voltage dropping coil for the motor power supply. To illustrate the possibility of such components being provided a box 18 is shown in dotted outline in FIG. 8.

Preferably, the support and the case are made from an extrudable ceramic material, for example that known as Cordierite.

The support is formed in two-stage operation. The first stage consists of extruding the ceramic material into the basic cylindrical form of the support that is to say a form having a transverse cross section as shown in FIG. 1 but with longitudinally continuous sections 3.

Conveniently, the support is extruded in relatively long lengths and is then cut into shorter lengths as required.

Before the shorter lengths of extruded ceramic material are fired, they are machined to cut the two-start helical slot 6. The lengths are then fired.

The case 10 is also formed by an extrusion process.

It is not essential that a two-start thread be employed; a single start thread could by used instead.

Equally, the longitudinal slots need not be equispaced. It may be desired to use non-equal spaceing to ensure correct orientation of the case in applications of the invention where this is important.

It will be appreciated that a support of the form described above is capable of economic mass production. The insertion of the heating coil may also be effected by machinery thereby further reducing the cost of the final assembly.

Figure 11:
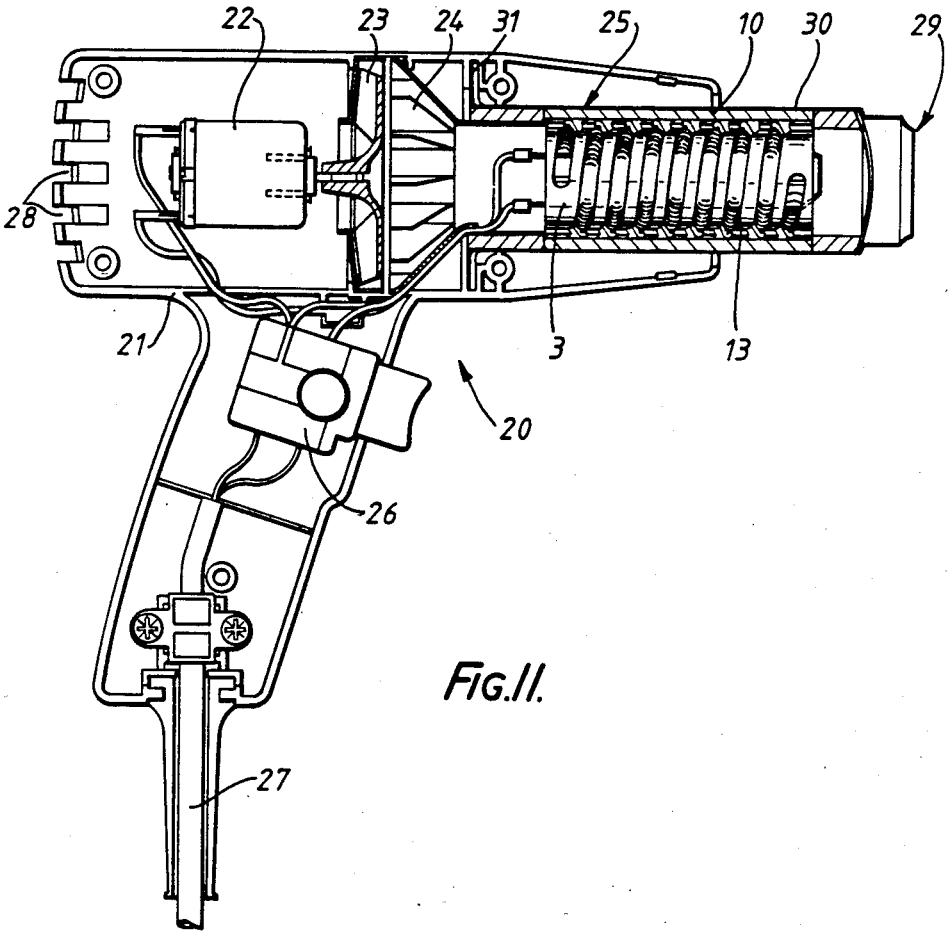
FIG. 11 is a sectional side view of a hot air gun incorporating the support and heating element of FIG. 4 and the sleeve of FIG. 5.

The constructions described above are particularly suitable for use in a hot air gun of the kind that may be used as a paint stripper. FIG. 11 shows how a heating element assembly 25 such as that shown in FIG. 7 may be incorporated in such a hot air gun 20.

The gun 20 has a clam shell housing 21 in the barrel of which a motor 22, a fan 23, a diffuser 24, and the heating element assembly 25 are located and in the handle of which a trigger operated electric switch 26 is provided. Power is supplied to the gun through a cord 27 connected to the switch 26, the motor 22 and the heating element assembly 25 being connected to the switch 26. The motor 22 may be a permanent magnet motor and will usually be arranged to operate at a voltage substantially below mains voltage. The reduced voltage for the motor 22 may be obtained in any suitable way. One method which may be employed is to include in the heating element coil a short coil from which the reduced voltage is derived. Such an arrangement is described more fully later with reference to FIG. 14.

The housing 21 has air inlet defined by apertures 28 and a hot air outlet 29. The heating element assembly 25 is aligned with the outlet of the diffuser 24 and both the downstream end of the diffuser and the assembly 25 are mounted in a steel tube 30 having a flange 31 by which the tube is located in the housing 21.

In operation of the gun the fan 23 is driven by the motor 22 and air is drawn into the gun through the apertures 28, and passes through the fan 23 and the diffuser 24 to the heating element assembly 25. Most of the air passes through the longitudinal passageways 16 over the heating coil 13 by which it is heated and out through the outlet 29; small amounts of air also pass through the centre of the core 1 and through any gap between the case 10 and the wall sections 3.

Figure 12:
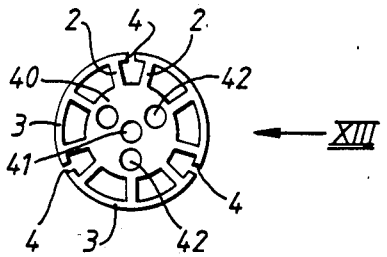
FIG. 12 is an end view of a third form of heating element support.
Figure 13:
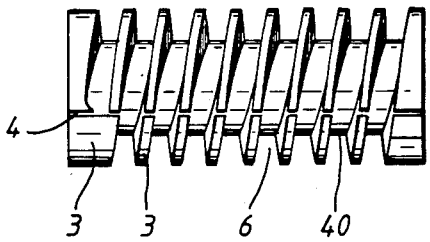
FIG. 13 is a view of the support shown in FIG. 12 in the direction of the arrow XIII in FIG. 12.
Figure 14:
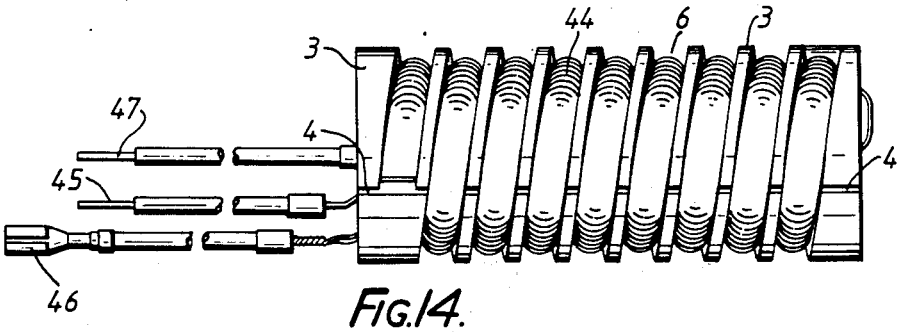
FIG. 14 is a view similar to FIG. 13 but showing a heating element mounted on the support.

FIGS. 12 and 13 show a third form of support embodying the invention and FIG. 14 shows a heating element 44 mounted on the support. The support and heating element are generally similar to that shown in FIGS. 1 to 4 and corresponding parts are designated by the same reference numerals. The core 40 of the support is of considerably greater diameter and has a coaxil longitudinal bore 41 and three further longitudinal bores 42. Thus, as in the embodiment of FIGS. 6 and 7, the bottom of the helical slot 6 is defined by the outside of the core and is continuous. The support of FIGS. 12 and 13 is not intended to mate with any case such as the case 10 and therefore the longitudinal slots 4 are much narrower being provided solely for use when winding the heating coil on the support; it will also be noted that there are no counterparts to the ribs 5 of the support of FIGS. 1 to 3 but that more of the ribs 2 are provided. The helical slot 6 formed in the support of FIGS. 12 and 13 has a single start thread and the winding of the heating coil on the support is different to that described with reference to FIGS. 1 to 4, as will now be explained.

Referring to FIGS. 12 to 14, the heating coil 44 actually consists of two coils connected in series, one coil being very short and occupying only about two thirds of a turn around the core. The coil 44 can be wound from the left hand end as seen in FIG. 14. One end lead 45 of the coil, which end defines one end of the short coil, is slipped through one of the slots 4 and winding of the coil commenced. After winding the coil two thirds of the way around the former the other end of the short coil and the first end of the main coil, which ends are joined together are reached. These ends are brought out of the left hand end of the support (as seen in FIG. 14) and connected to a terminal 46. The rest of the main coil is then wound around the former and the end of the coil slipped through one of the slots 4 at the right hand end of the support (as seen in FIG. 14) and passed back through the coaxial longitudinal bore 41 where it terminates as a lead 47.

Figure 15:
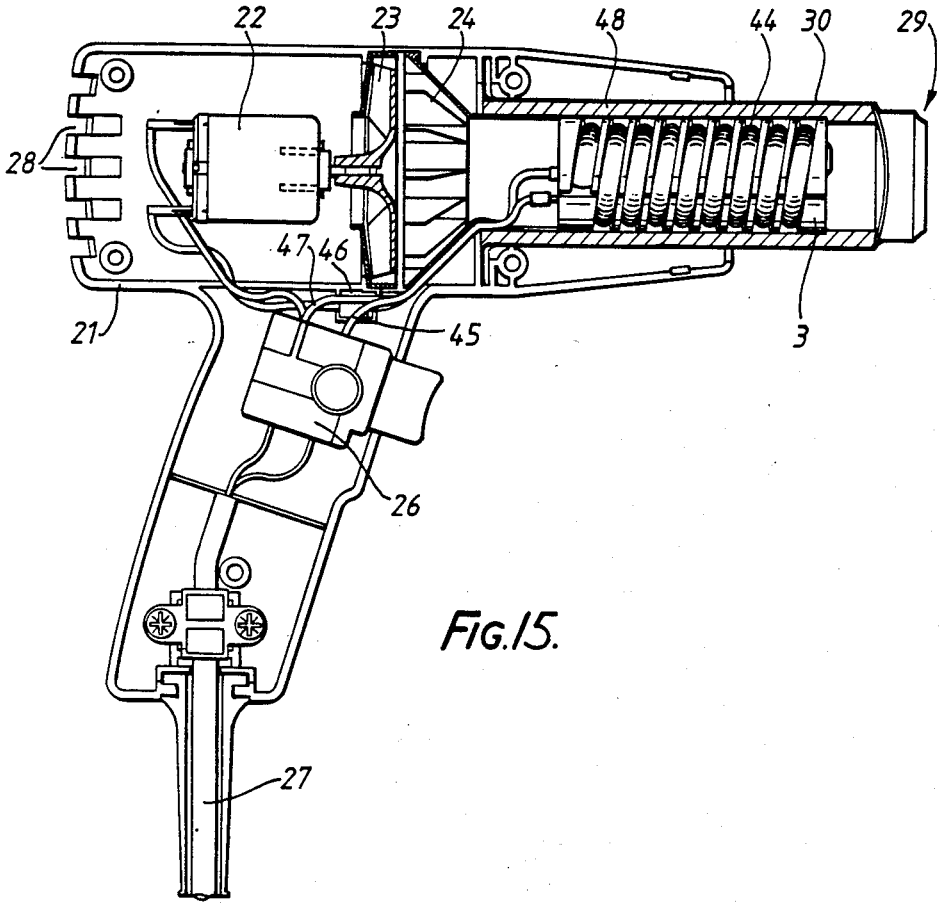
FIG. 15 is a sectional side view of a hot air gun incorporating the support and heating element of FIG. 14.

FIG. 15 shows the heating element assembly comprising the support and heating element of FIGS. 12 to 14 installed in a hot air gun. The gun is very similar to that shown in FIG. 11 and corresponding parts are designated by the same reference numerals. As already mentioned, no case such as the case 10 is provided for the heating element assembly. Instead the support is mouned directly inside the steel tube 30 which is provided with an electrically insulating liner 48 in which the assembly is snugly received. The leads 45 and 47 of the heating coils 44 are connected across the mains supply via the switch 26. The motor 22 is connected to the terminal 46 and to the same terminal of the switch 26 as that to which the lead 45 is connected. Thus only a small proportion of the mains voltage, namely that tapped by the short coil of the heating coil 44, is supplied to the motor 22.

It will be understood that the support shown in FIGS. 12 and 13 can be made by a first extrusion step followed by machining of the helical slot and firing of the support in substantially the same way as described above in relation to the support of FIGS. 1 to 3.

Figure 16:
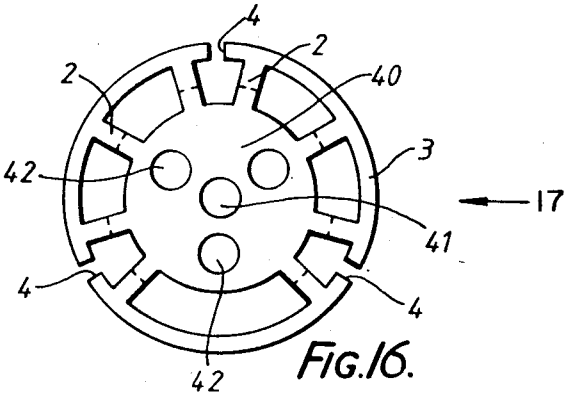
FIG. 16 is an end view of a fourth form of heating element support.
Figure 17:
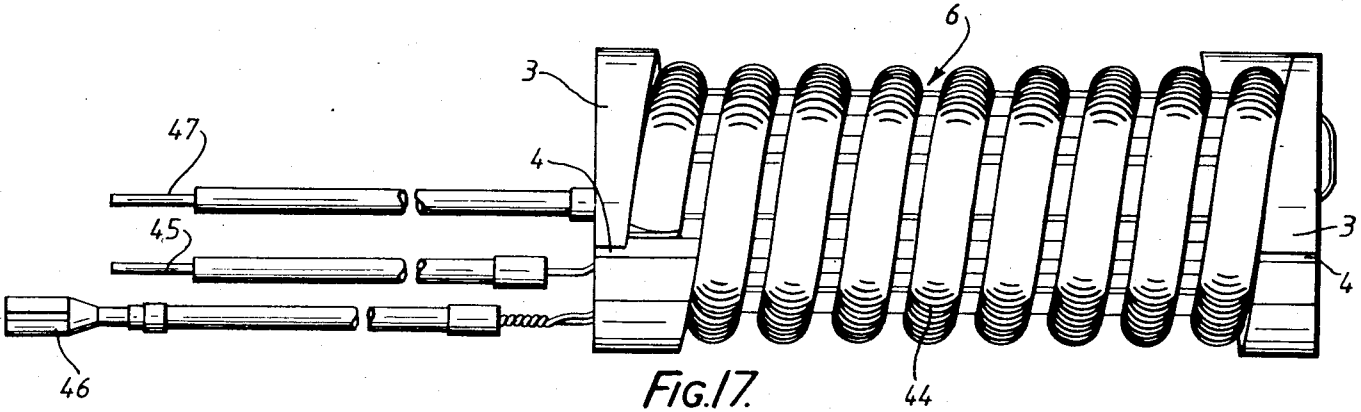
FIG. 17 is a view of the support shown in FIG. 16 in the direction of the arrow 17 in FIG. 16, showing a heating element mounted on the support.

FIGS. 16 and 17 show a support and heating element very similar to that shown in FIGS. 12 to 14 and corresponding parts are designated by the same reference numerals in the drawings. There is only one difference between the two forms of element and that is that the element of FIGS. 16 and 17 is subjected to an additional machining step after machining of the helical slot 6, the additional machining step comprising the removal of all the wall sections 3 along a central portion of the support together with removal of the outer portions of all the ribs 2 along the same central portion. The tips of the remaining portions of the ribs are shown by dotted line in FIG. 16. The ribs 2 and the wall sections 3 are left intact at both ends of the support and enable the support to be located in the liner 48 of the gun of FIG. 15 as in the previous embodiment.

The removal of portions of the wall sections 3 and ribs 2 facilitates the passage of air past the heating coil 44 but involves an additional machining step in the production of the support.

While in the preferred embodiment of the invention the supports are made by extrusion and subsequent machining it is also within the scope of the invention for the supports to be made by other methods, for example by pressing.

What is claimed is:

1. An air heater, comprising;

a housing;

an electric motor mounted in said housing;

a fan connected to said motor to be driven thereby;

inlet means, communicating with said fan, for passage of air into said housing;

outlet means, communicating with said fan, for discharge of said air out of said housing;

heating means, disposed between said fan and said outlet means, for heating at least some of said air to enable hot air to be discharged through said outlet means;

said heating means comprising a former, a heating element wound on the former, and a sleeve surrounding said former and said element;

said former comprising an integral ceramic mass having a lengthwise extending cylindrical core from which radially outwardly extend angularly spaced-apart ribs, at least some of said ribs being integrally connected at their radially outer periphery to a cylindrical outer wall surrounding said core;

said ribs extending lengthwise along said cylindrical core from end to end thereof;

said ribs dividing an annular space defined between said core and said outer wall into a plurality of longitudinally extending cavities bounded on a radially outer periphery by said outer wall and bounded on a radially inner periphery by said core;

a helical groove formed in and extending around said former, said groove passing through said outer wall and radially outer portions of said ribs;

said groove commencing adjacent but inward of one end of said outer wall and terminating adjacent but inward of an opposite end of said outer wall;

said heating element being located in said groove below a radially outer peripheral surface of said outer wall, said heating element successively passing transversely through said cavities; and said cavities extending between said fan and said outlet means for passage of said at least some of said air through said cavities over said heating element.

2. The air heater of claim 1, wherein said sleeve is a sliding fit over said former.

3. The air heater of claim 1, wherein said sleeve is provided with integral internal longitudinal keys, and said keys mate in longitudinal slots in said outer wall.

4. The air heater of claim 3, further comprising a steel tube in which said sleeve is mounted.

5. The air heater of claim 1, wherein said sleeve is a steel tube provided with an electrically insulating liner, and said former is snugly received within said sleeve.

6. The air heater of claim 1, wherein said heating element comprises a length of coiled resistance wire.

7. The air heater of claim 1, wherein a similar and parallel helical groove is formed in and extends around said former, said two grooves forming a double start helical arrangement, said heating element being located for a first portion of its length in one of said grooves and for another portion of its length in the other of said grooves.

8. The air heater of claim 7, wherein an intermediate part of said heating element connecting said first and another portions passes externally of one end of said former.

9. A hot air gun, comprising;

a housing having mounted therein an electric motor drivingly connected to a fan;

inlet means, in said housing, for inlet of air drawn into said housing by said fan;

outlet means for outlet from said housing of air discharged by said fan;

heating means, disposed between said inlet means and said outlet means, for heating air while passing from said inlet means to said outlet means;

said heating means comprising a length of coiled resistance wire wound helically in a support element, said length of coiled wire having at ends thereof connection wires electrically connected to a switch in said housing;

said support element being made of a heat resisting material and extending along a longitudinal axis;

said support element comprising a longitudinal core from which integrally extend radially outwards away from said axis a plurality of ribs, each rib extending lengthwise continuously from one end of said core to an opposite end of said core;

said support element including an outer wall encircling said ribs and integrally attached to radially outer extremities of at least some of said ribs;

a plurality of cavities extending longitudinally through said supprot element, said cavities extending between adjacent ribs from said one end to said opposite end of said core, said cavities being bounded radially inwardly by said core and radially outwardly by said outer wall;

a helical groove encircling said core and extending along said support element, said groove being formed through said outer wall and portions of said ribs;

said coiled resistance wire being wound in said groove around said core, said coiled resistance wire successively passing through said cavities transversely to said axis;

each said connection wire passing through at least a portion of one of said cavities and extending from an end of said support element; and said cavities communicating at one end with said fan and at an opposite end with said outlet means, air from said fan passing longitudinally through said cavities over said coiled resistance wire.

10. The hot air gun of claim 9, further comprising a cylindrical sleeve surrounding said support element and in which said support element is a snug fit.

11. The hot air gun of claim 9, further comprising an air diffuser disposed between said fan and said support element and located in an air flow from said fan to said cavities.

12. The hot air gun of claim 9, wherein said core has a central passageway longitudinally therethrough, said passageway communicating at one end with said fan and at an opposite end with said outlet means, some air from said fan passing to said outlet means via said passageway.

13. The hot air gun of claim 9, wherein said groove stops short of each end of said support element.

14. A hot air device, comprising;

a housing having a handle;

an electric motor mounted in said housing;

a fan connected to said motor to be driven thereby;

inlet means, communicating with said fan, for passage of air into said housing;

outlet means, communicating with said fan, for discharge of said air out of said housing;

heating means for heating at least some of said air to enable hot air to be discharged through said outlet means;

said heating means comprising a former, a heating element wound on said former, and a sleeve surrounding said former and said element;

said former comprising an integral mass of extrudable heat resisting material and having a lengthwise extending central core from which outwardly extend angularly spaced-apart ribs integrally connected at outer portions to a cylindrical outer wall surrounding said core;

each said rib extending lengthwise along said central core from end to end thereof;

said ribs dividing a space defined between said core and said outer wall into a plurality of longitudinally extending cavities bounded on an outer periphery by said outer wall and bounded on an inner periphery by said core;

a double-start helical groove arrangement comprising two grooves formed in and extending around and along said former, said two grooves extending through said outer wall and portions of said ribs;

said heating element being located in and extending along said two grooves and successively passing transversely through said cavities;

said heating element extending along one of said two grooves in one direction then transferring to and returning along the other of said two grooves in an opposite direction with opposite ends of said heating element both at one end of said former; and said cavities being in communication at opposite ends with said inlet means and said outlet means for passage of said at least some of said air through said cavities over said heating element.

15. The hot air device of claim 14, wherein said heating element comprises coiled resistance wire extending through said grooves.

16. The hot air device of claim 15, wherein said sleeve has a plurality of longitudinally extending internal keys slidably mated in parallel longitudinal slots in said outer wall, and further comprising a steel tube surrounding said sleeve and in which said sleeve is a snug fit.

17. A hot air gun, comprising;

a housing having mounted therein an electric motor drivingly connected to a fan;

inlet means, in said housing, for inlet of air drawn into said housing by said fan;

outlet means for outlet from said housing of air discharged by said fan;

heating means, disposed between said inlet means and said outlet means, for heating air while passing from said inlet means to said outlet means;

said heating means comprising a heating element wound helically in and around an extruded support element;

said support element being made of an extrudable heat resisting material and extending along a central longitudinal axis;

said support element comprising a longitudinal core from which integrally extend radially outwards away from said axis a plurality of ribs, each rib extending lengthwise from one end of said core to an opposite end of said core;

said support element including an outer wall encircling said ribs and integrally attached to radially outer extremities of at least some of said ribs;

a plurality of cavities extending longitudinally through said support element, said cavities being defined between adjacent pairs of ribs and extending from said one end to said opposite end of said core, said cavities being bounded radially inwardly by said core and radially outwardly by said outer wall;

a helical groove encircling said core and extending along said support element, said groove being formed through said outer wall and portions of said ribs;

said heating element being wound in said groove around said core, and successively passing through said cavities transversely to said axis;

longitudinal parallel slots through said outer wall, each slot communicating with one of said cavities throughout the length thereof and being narrower in width than that cavity;

each said slot successively intersecting consecutive turns of said helical groove; and said cavities each being in communication at one end with said inlet means and at an opposite end with said outlet means, air being caused by said fan to flow longitudinally through said cavities over said heating element.

18. The hot air gun of claim 17, wherein some of said ribs are not attached to said outer wall and have free radially outer extremities in register with and partially blocking said slots; and further comprising a sleeve surrounding said outer wall and having longitudinal inwardly extending keys slidably mating in said slots.

19. The hot air gun of claim 18, further comprising a steel tube mounted in and extending from said housing, said sleeve being disposed inside said tube and being a snug fit therein with portions of said sleeve, said support element and said heating element extending beyond said housing inside said tube.

* * * * *